US005944649A

United States Patent [19]

Karlsson

[11] Patent Number: 5,944,649

[45] Date of Patent: Aug. 31, 1999

[54] METHOD AND DEVICE FOR THE SUPPLY OF CONTROL LIQUID TO A CENTRIFUGAL SEPARATOR

[75] Inventor: Per Gunnar Karlsson, Hägersten, Sweden

[73] Assignee: Alfa Laval AB, Lund, Sweden

[21] Appl. No.: 09/117,156

[22] PCT Filed: Jan. 24, 1997

[86] PCT No.: PCT/SE97/00114

§ 371 Date: Jul. 24, 1998

§ 102(e) Date: Jul. 24, 1998

[87] PCT Pub. No.: WO97/27945

PCT Pub. Date: Aug. 7, 1997

[51] Int. Cl.[6] ..... B04B 1/10; B04B 11/04

[52] U.S. Cl. ..... 494/37; 494/27; 494/29; 494/30; 494/40; 494/41; 494/48; 210/139; 210/371; 210/787

[58] Field of Search ..... 210/139, 371, 210/787; 494/29, 30, 40, 41, 37, 48, 27

[56] References Cited

U.S. PATENT DOCUMENTS 4,510,052 4/1985 Eklof ..... 210/139

FOREIGN PATENT DOCUMENTS 40 26 952 9/1991 Germany .
90/00768 1/1990 WIPO .

*Primary Examiner*—David A. Reifsnyder
*Attorney, Agent, or Firm*—Fish & Richardson P.C.

[57] ABSTRACT

Method and device (21) for the supply of control liquid to a rotor of a centrifugal separator, which device (21) includes a cylinder (25), in which a movable wall element (26) is arranged, which axially delimits a storing chamber (29) in the cylinder (25). In the storing chamber (29) a predetermined volume of control liquid is stored. Control liquid is pressed out of the storing chamber (29) into the rotor during axial displacement of the wall element (26). Furthermore, the invention includes a centrifugal separator, which is provided with such a device (21). A portion of the control liquid in the storing chamber (29) is pressed upon displacement of the wall element (26) a first distance out through a first outlet passage (33) in the device with a high flow. The first outlet passage (33) is then closed when the wall element (26) has been displaced this distance. A portion of the remaining control volume of control liquid in the storing chamber (29) is pressed out of the storing chamber (29) upon continuing displacement of the wall element (26) a second distance through a second outlet passage (36) in the supplying device (21) with a flow, which is substantially lower than the first flow.

7 Claims, 2 Drawing Sheets

METHOD AND DEVICE FOR THE SUPPLY OF CONTROL LIQUID TO A CENTRIFUGAL SEPARATOR

FIELD OF THE INVENTION

The present invention concerns a method of supplying a control liquid to a rotor of a centrifugal separator by means of a supplying device, which has a cylinder, in which an axially displaceable wall element is arranged, which axially delimits a storing chamber arranged in the cylinder, in which a predetermined volume of control liquid is stored, and out of which at least a portion of this volume of control liquid is pressed during operation out of the storing chamber into the rotor upon axial displacement of the wall element.

The invention also concerns a device for supplying of control liquid to a rotor of a centrifugal separator. A device of this kind comprises a cylinder, in which an axially displaceable wall element is arranged, which axially delimits a storing chamber arranged in the cylinder, the storing chamber being arranged to store a predetermined volume of control liquid. To the storing chamber there is connected an inlet for the supply of control liquid to the storing chamber upon displaceable of the wall element in a first direction and an outlet passage arranged in the supplying device, through which at least a portion of the volume of control liquid stored in the storing chamber is pressed out of the storing chamber into the rotor via a conduit connected to the outlet passage when control liquid is supplied to the rotor upon axial movement of the wall element in a second direction. Supplying devices of this kind also comprise means to press the wall elements in the second direction with a predetermined force, which is higher than the resulting force of a liquid pressure prevailing in the storing chamber when control liquid is supplied to the rotor.

Furthermore, the present invention concerns a centrifugal separator, which is provided with a device to supply control liquid to its rotor.

BACKGROUND OF THE INVENTION

U.S. Pat. No. 4,510,052 shows a centrifugal separator, which is provided with a device of this kind to supply control liquid to its rotor in a manner described above to intermittently open and re-close a peripheral passage when needed or at equal time periods to empty the separator chamber of the rotor of all its contents of product or a wanted portion thereof. The passage is kept closed by pressing the valve slide in a direction closing the passage by a pressure force of a control liquid, which is present in a so called closing chamber, which is provided with an outlet valve at its outermost portion. This outlet valve is opened for discharge of more or less of the content of control liquid in the closing chamber by supplying a certain volume of control liquid by means of an injector driven by pressurized air at a high flow into a so called opening chamber, which is provided with a throttled outlet at its outermost portion. The control liquid present in the opening chamber influences the outlet valve with a pressure force in a direction opening the outlet valve against the action of a resulting force from a number of springs.

Gradually, the opening chamber is filled up with control liquid, which is entrained into the rotation of the rotor. The free liquid surface of the control liquid is then displaced radially inwardly and reaches rapidly a certain radial level, at which the pressure force from the control liquid accumulated in the opening chamber upon lasting conditions when the control liquid is fully entrained into the rotation of the rotor would exceed the resulting spring force and open the outlet valve whereby the control liquid would flow out of the closing chamber. However, the supply of control liquid is taking place at such a high flow that the opening chamber is filled up radially inwardly to a level far inside the first mentioned radial level with control liquid, which only partly has been entrained into the rotation of the rotor, before the outlet valve opens and lets control liquid out of the closing chamber.

When the outlet valve has opened this rapidly results in that so much control liquid has flowed out of the closing chamber that the pressure from the remaining control liquid in the closing chamber no longer is able to keep the passage closed against the liquid pressure from the product present in the separation chamber instead the passage is opened and contents of product flows out of the separation chamber. How large portion of the contents of the separation chamber is that flows out through the passage is determined by for how long time the control liquid present in the opening chamber, which gradually flows out through the throttled outlet, is able to keep the outlet valve open, that is the volume of and the flow at which control liquid is supplied to the opening chamber before the outlet valve opens.

In the known supplying device the amount is regulated at each discharge occasion by adjusting the time, during which the high air pressure is acting on the injector and presses control liquid out of the same. The whereabouts for the time in these connections is very short, which makes it very difficult to discharge a wanted volume of product at sufficient accuracy and repeatability.

The closing chamber and the injector are refilled with control liquid from a source of control liquid, which often consists of a tank, which is located at a limited level above the centrifugal separator or of the general water conduit system. The refilling of the product, which is to be separated in the separation chamber after a discharge has taken place cannot be done quicker than refilling of the closing chamber without having product leaking out through the passage. Since the supply of product to the separation chamber normally is not shut off during the discharge procedure the supply flow of control liquid to the closing chamber in these cases has to be regulated and adapted to the supply flow of the product to the separation chamber.

Since the available liquid pressure of the source of control liquid is low and, furthermore, if it consists of the general water-conduit system often is heavily varying, it is very difficult to adjust a suitable supply flow. The fact that the available liquid pressure is low also means that conduits and valve having large throughflow area have to be used, which makes it even more difficult to adjust a suitable supply flow.

SUMMARY OF THE INVENTION

The object of the present invention is to accomplish a method and a device of the kind initially described for the supply of control liquid to a rotor of a centrifugal separator, which makes it possible first to supply a very well defined volume of control liquid at a high flow with a high repeatability and then to supply a further volume of control liquid at a flow, which is independent of outer circumstances which are difficult to control, such as the liquid pressure in the general water-conduit system.

According to the present invention this is accomplished by pressing during a first step after the supply has been initiated a predetermined portion of the volume of the control liquid stored in the storing chamber out of the storing chamber upon displacement of the wall element a first distance with an adjustable pressure through an outlet passage arranged in the supplying device against the influence of a first flow resistance in this outlet passage at a first flow, which is higher than a predetermined minimum flow, by closing at least a portion of the first outlet passage by means of an opening and closing element connected to the wall element when this has been displaced a first distance, and by pressing during a second step following the first step at least a portion of the remaining volume of control liquid in the storing chamber upon continuing displacement of the wall element a second distance against the second flow resistance, which is higher than the first flow resistance, out of the storing chamber through a second outlet passage arranged in the supplying device with a second flow, which is substantially lower than the first flow.

To accomplish this a device to supply a control liquid to a rotor of a centrifugal separator according to the present invention comprises a first outlet passage, which connects the storing chamber with said conduit, and which is arranged to admit a first flow, which is higher than a predetermined minimum flow of control liquid out of the storing chamber against the influence of a first flow resistance upon displacement of the wall element in the second direction a predetermined first distance, and a second outlet passage, which also connects the storing chamber with the conduit, and which is arranged to admit a second flow, which is essentially lower than the first flow, out of the storing chamber against the influence of a second flow resistance against this second flow, which is higher than the first flow resistance, upon displacement of the wall element in the second direction a second distance. Furthermore, the device according the the invention comprises an opening and closing element connected to the wall element, which is arranged to open and to keep the first outlet passage open during the displacement of the wall element the first distance in the second direction and at least partly close the first outlet passage when the wall element has been displaced the first distance and to keep the first outlet passage at least partly closed upon the continued displacement of the wall element in the second direction.

In an other embodiment of the invention the first and the second outlet passages are kept closed during displacement of the wall element a third distance, which keeps the first and the second distance apart, the device also comprising a third outlet passage, through which the storing chamber is connected to the conduit, and through which control liquid is brought to flow at least during the displacement of the wall element the third distance against a third flow resistance, which is higher than the second flow resistance, whereafter the second outlet passage is opened and is kept open during the displacement of the wall element a second distance.

Preferably, control liquid is pressed out of the storing chamber during the first step with a flow, which at least is double as high as the flow at which control liquid is pressed out of the storing chamber during the second step.

In a preferred embodiment of the invention the wall element is pressed in the second direction by means of pressurized air, the wall element also delimiting axially a pressure chamber, which is arranged to be filled up with pressurized air at an adjustable pressure during displacement of the wall element in the second direction and to be emptied of air during displacement of the wall element in the first direction.

BRIEF DESCRIPTION OF THE DRAWINGS

In the following the invention will be described more closely with reference to the attached drawings, on which FIG. 1 schematically shows an axial cross section through a rotor of a centrifugal separator, which is provided with a device, by means of which control liquid can be supplied to the rotor in accordance with the present invention, FIG. 2 schematically shows in more detail a longitudinal section through a supplying device according to one embodiment of the invention.

DETAILED DESCRIPTION

Figure 1:
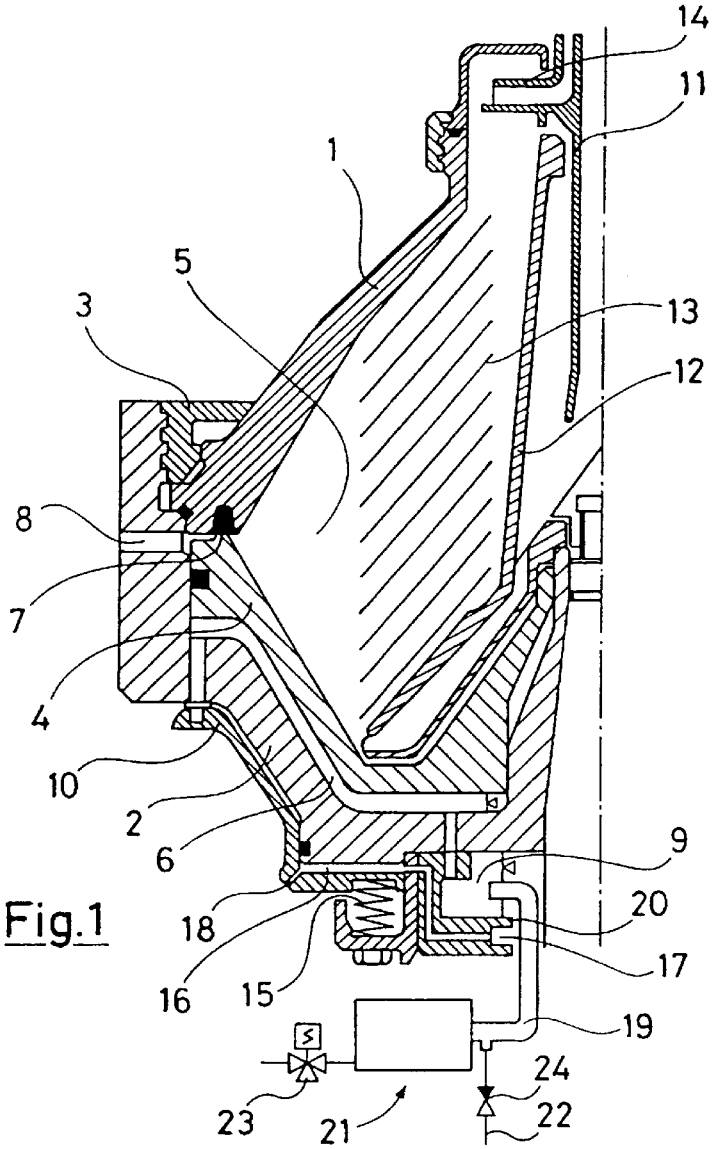

The rotor shown in FIG. 1 has an upper part 1 and a lower part 2, which are kept together by a locking ring 3. Inside the rotor there is an axially movable valve slide 4, which, together with the upper part 1 delimits a separation chamber 5. Together with the lower part 2 the valve slide 4 delimits a closing chamber 6, which is arranged to open and close an annular passage 7 surrounding the rotational axis of the rotor, which connects the radially outermost part of the separation chamber 5 with outlet openings 8 arranged in the lower part 2 of the rotor, through which more or less of the product content in the separation chamber 5 is let out intermittently. The closing chamber 6 is provided with a central inlet 9 for the supply of control liquid and at its radially outermost portion it is provided with an outlet valve 10 for the discharge of control liquid out of it. The control liquid present in the closing chamber 6 acts during operation with a pressure force on the valve slide 4 in a direction closing the passage 7 against the influence of the pressure force from the product present in the separation chamber 5.

Centrally in the rotor a stationary inlet tube 11 opens for the supply of the product, which is to be centrifugally treated. The inlet tube 11 is surrounded by a distributor 12, which distributes the supplied product out to the separation chamber 5, in which the components in the product are separated. The main separation then takes place in interspaces between separation discs 13 arranged in a stack in the separation chamber 5. On the central inlet tube 11 a stationary discharge device 14 is arranged for centrally discharging of a separated specifically light component, which is present in the supplied product.

The axially movable outlet valve 10 is pressed by the pressure force from a number of helically coiled springs 15 distributed around the rotational axis in a direction closing the outlet valve 10. The outlet valve 10 delimits together with the lower part 2 of the rotor an opening chamber 16, which has a central inlet 17 for the supply of controlling liquid to the opening chamber 16 and a throttled outlet 18, through which control liquid present in the opening chamber 16 flows out of the same. Control liquid is supplied to the inlet 17 of the opening chamber 16 via conduit 19, which also supplies control liquid to the inlet 9 of the closing chamber 6, in which inlet 9 the conduit 19 opens. The inlet 17 of the opening chamber 16 communicates with the inlet 9 of the closing chamber 6 via an overflow outlet 20, over which control liquid flows into the inlet 17 of the opening chamber 16 when the closing chamber 6 is filled up radially inside this overflow outlet 20. Control liquid, which is present in the opening chamber 16, influences the outlet valve 10 with a pressure force in opening direction against the influence of the pressure force from the helically coiled springs 15.

To the conduit 19 a device 21 is connected for the supply of control liquid to the rotor via the conduit 19. This supplying device 21 is connected to a conduit 22 for the supply of control liquid and to a presssurized air conduit, through which air of a predetermined, preferably adjustable, pressure can be supplied or evacuated out of the supplying device 21 by turning a three-way valve 23. In the examples in the figures the three-way valve is electromagnetically controlled but in installations, in which explosion security is required, it is suitable to choose a pneumatically control three-way valve. The conduit 22 for the supply of control liquid is in the shown examples provided with a back flow valve 24. In many cases the conduit system for the supply of control liquid has such a high resistance against back flow that this valve can be done without.

Figure 2:
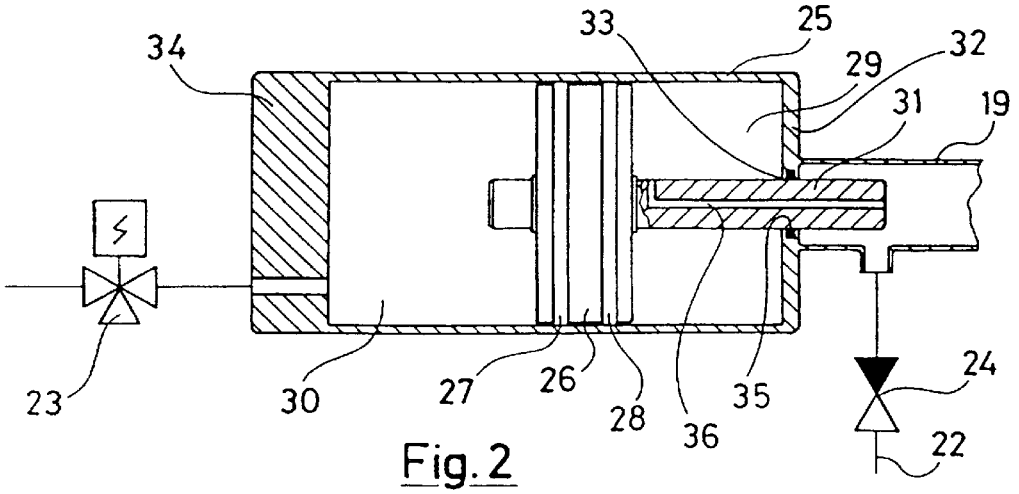

In FIG. 2 an embodiment of a supplying device according to the invention is shown in more detail. This has a cylinder 25, in which an axially movable wall element 26 is arranged. The wall element 26 sealingly abuts a cylindrical inner surface in the cylinder 25 during displacement of the wall element 26 by means of two sealing rings 27 and 28, which are located at such a big axial distance from each other that an inclination of the wall element 26, which can make the axial displacement of it more difficult, is prevented.

Axially on one side of it the wall element 26 delimits a storing chamber 29 and on the opposite side of it a pressure chamber 30. A preferably circular cylindrical element 31 is fixedly connected to the wall element 26 on the side of it facing the storing chamber 29. The longitudinal axis of the elelment 31 is parallel to, preferably coaxial to, the axis of the cylinder 25. The wall element 26 is pressed towards the end wall 32 of the cylinder, which together with the wall element 26 delimits the storing chamber 29 axially in one direction each, when the three-way valve 23 is set in the position, in which the pressure chamber 30 is connected to the source of air at the high pressure. In another position of the three-way valve 23 the pressure chamber 29 is connected to the surrounding atmosphere for evacuating of the air contents of the pressure chamber 30.

In the end wall 32 a first outlet passage 33 is arranged, which connects the storing chamber 29 to the conduit 19 and is arranged to admit a first flow, which is higher than a predetermined minimum flow of control liquid out of the storing chamber against the influence of a first low flow resistance. The minimum flow is higher than the maximum flow, at which control liquid flows out of the opening chamber through the throttled outlet 18.

The conduit 22 for the supply of control liquid from a source of control liquid is in the example shown in FIG. 2 connected to the conduit 19. The first outlet passage 33 is coaxial to the element 31 and has the same cross section as the element 31. The element 31 has an axial extension, which is shorter than the maximum axial extension of the storing chamber 29. Hereby, all of the element 31 will during displacement of the wall element 26 a first distance from its end position towards a second end wall 34 of the cylinder 25, which is located to the left in the example shown in the figure, be located inside the storing chamber 29.

When the wall element 26 has been displaced this first distance the element 31 reaches the end wall 32 and closes the first outlet passage 33, which is provided with a sealing ring 35. This sealing ring seals against the outer contour of the element 31 during continuing displacement of the wall element 26 and the element 31 a second distance in the same direction as during the first distance. In FIG. 2 the wall element 26 is shown in a position, in which it is located during displacement of it this second distance.

In the element 31 there is arranged a second outlet passage 36, which also connects the storing chamber to the conduit. Upon displacement of the wall element 26 and the element 31 a second distance this second outlet passage 36 admits a second flow, which is substantially lower than the first flow, out of the storing chamber against the influence of a second flow resistance on this second flow, which is higher than the first flow resistance.

How long this second distance is, which the wall element 26 is displaced and presses control liquid out of the storing chamber 29 and consequently how large the volume of control liquid, which during this displacement, is supplied to the rotor at said second flow, is determined by the time, during which air of high pressure is connected to the pressure chamber 30 via the three-way valve 23. The pressure chamber 30 is connected to the source of air of the high pressure when the three-way valve is set in one position, whereas it in an other position by the three-way valve 23 is connected to the surrounding atmosphere for evacuating of the air contents of the pressure chamber 30. The wall element 26 can not be displaced further than to the end position of it turned towards the end wall 32. In the shown example the maximum displacement of the wall element 26 is delimited by the end wall 32. If you also want to control the volume of control liquid supplied to the rotor during the displacement of the wall element the second distance the stop element having a wanted axial length can for instance be inserted in the storing chamber and be connected to the end wall 32.

Figure 3:
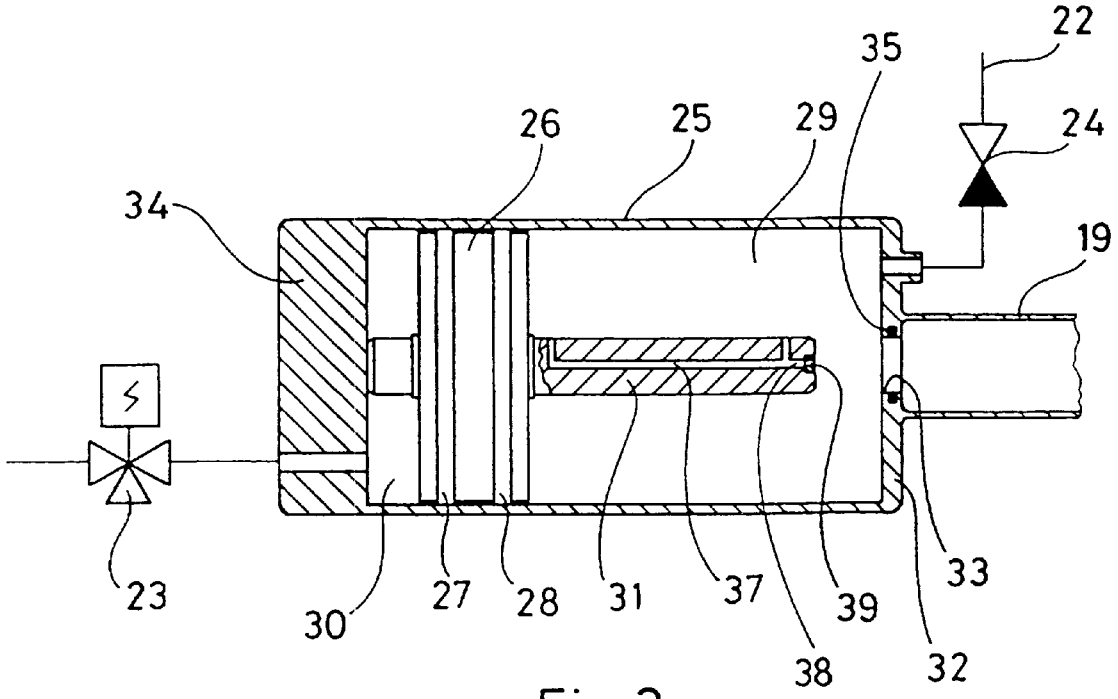
FIG. 3 shows a longitudinal section through a supplying device according to an other embodiment of the invention.

The embodiment of a supplying device according the invention shown in FIG. 3 differs from the embodiment shown in FIG. 2 in that the conduit 22 for the supply of control liquid from a source of control liquid in this example is connected directly to the storing chamber at the end wall 32 of the cylinder 25 and not via the conduit 19. Furthermore, the end of the second outlet passage 37 turned from the wall element 26 does not open in the axially end surface of the element 31 but in its circumferencial surface at a distance from its axial end. During its displacement axially in the second direction, which is to the right in the figure, the element 31 will close the first outlet passage 33 for a while before the second passage 37 is opened and control liquid can flow out of the storing chamber 29 through the same. Hereby, when needed, you may obtain a clear separation between the supply flow during displacement of the wall element 26 the first distance and the supply flow during the displacement of the wall element 26 the second distance.

To make a displacement of the wall element 26 and the member 31 possible the short distance, during which displacement the first outlet passage 33 and the second outlet passage 37 are closed, a third outlet passage 38 is arranged in the element 31. This third outlet passage 38 is provided with a restriction 39 with such a high flow resistance that only a low flow can flow out of the storing chamber 29 during the displacement of the wall element 26 this short distance. Besides, in FIG. 3 the wall element 26 is shown in its end position, in which the storing chamber 29 has its largest volume.

The supply of control liquid to the rotor of a centrifugal separator by means of the device 21 which is connected to the rotor via the conduit 19 takes place according to the present invention in the following way:

Before a supply of control liquid is initiated in order to, for instance, as in the embodiments shown in the figures, open and re-close a passage 7 to let out more or less of the product contents of the separation chamber 5 when needed or at equal time periods, the three-way valve 23 has been set in the position, at which the storing chamber 29 is evacuated of its air contents, during at least such a long time, which is needed for the pressure of the control liquid in the conduit to press the wall element 26 in a first direction to its end position towards the end wall 34 of the cylinder 25 and completely refill the storing chamber 29.

When a supply of control liquid has been initiated the three-way valve 23 is turned so that the pressure chamber 30 is connected to the source of air of a pressure, which is essentially higher than the pressure of the control liquid in the storing chamber 29. Hereby, the wall element 26 is displaced in a second direction towards the end wall 32. Upon displacement of the wall element 26 a first distance it presses control liquid out of the storing chamber 29 through the first outlet passage 33, which admits a high first flow through the same against the influence of a low first flow resistance, and further through the conduit 19, which opens in the annular inlet 9 of the closing chamber 6 in the rotor. In the inlet 9 the control liquid rotates with a radially inwardly directed free liquid surface, which in the FIG. 1 is marked with a triangle. During normal conditions of operation the conduit 19 opens at a radial level, which is located so much radially outside the radial level of the free liquid surface that equilibrium at the opening is at hand between the pressure from the rotating liquid body and the pressure from the conduit 22 for the supply of control liquid. Since the wall element 26 presses control liquid out of the storing chamber 29 at a substantially higher pressure the free liquid surface in the inlet 9 will be displaced radially inwardly and be located radially inside the radial level of the overflow outlet 20. This results in that control liquid flows via the overflow outlet 20 into the opening chamber 16 at a flow, which is higher than the flow, which passes out through the throttled outlet 18 whereby the opening. chamber 16 gradually is filled up radially inwardly. Control liquid flows into the opening chamber 16 as long as the outlet valve 10 keeps the closing chamber 6 closed. The supply of control liquid takes place at such a high flow that the opening chamber 16 will be filled by control liquid, which only partly has been entrained into the rotation of the rotor radially inwardly to a radial level, which is far inside the radial level, at which the pressure force from the control liquid accumulated in the opening chamber 16 during lasting conditions with fully entrained control liquid would exceed the resulting pressure force from the springs 15 and open the outlet valve 10, before the outlet valve 10 opens and control liquid flows out of the closing chamber 6.

When the outlet valve 10 has opened control liquid flows out of the closing chamber 6, which in turn means that the passage 7 is opened and more or less of the product contents of the separation chamber 5 flows out through the outlet openings 8. The fact that control liquid flows out of the closing chamber 6 also means that no more control liquid flows into the opening chamber 16 and control liquid in the opening chamber 16 is gradually drained out through the throttled outlet 18. Eventually the opening chamber is only filled up radially to a radial level, at which the pressure force from the control liquid accumulated in the opening chamber 16 even if it is fully entrained does not longer exceed the resulting pressure force of the springs 15.

This results in that the outlet valve 10 closes the outlet out of the closing chamber 6.

How much control liquid, which has flown out of the closing chamber 6 and indirectly how great portion of the product content of the separation chamber, which has flown out through the outlet openings 8, depends on for how long time control liquid in the opening chamber is able to keep the outlet valve open.

In close connection to this the wall element 26 has been displaced the first distance and the element 31 connected to the wall element 26 reaches the first outlet passage 33 and closes it.

During continuing displacement of the wall element 26 the first outlet passage 33 is closed while a second outlet passage 36 or 37 is open during displacement of the wall element 26 a second distance.

This second outlet passage 36 or 37, which during displacement of the wall element 26 the second distance connects the storing chamber 29 to the conduit 19, admits a second flow through the same against the influence of a second flow resistance, which is higher than the first flow resistance. This second flow of control liquid flows into the closing chamber 6 via the conduit 19 and the inlet 9 of the closing chamber and fills gradually up the closing chamber radially inwardly. This second flow is then adapted to the supply flow through the inlet tube 11 of the product, which shall be centrifugally treated. The volume of control liquid, which is supplied to the closing chamber 6 during displacement of the wall element the second distance is regulated by adjusting the time, during which the pressure chamber is connected to the pressurized air source of high pressure, or by inserting of a mechanical stop into the storing chamber 29, which delimits the displacement of this second distance of the wall element 26. The volume is then adapted in a way such that the opening of the conduit 19 after that the wall element 26 has been displaced the second distance is located partly immersed radially outwardly in the rotating liquid body in the inlet 9.

After that the three-way valve 23 is turned in a way such that the pressure chamber 30 is connected to the surrounding atmosphere. Hereby, the air in the pressure chamber 30 can be evacuated and the storing chamber 29 be refilled with control liquid by the wall element 26 being brought back by the pressure of the control liquid in the conduit 22 towards the end wall 34 of the cylinder 25.

The supply flow during the displacement of the wall element 26 the first distance and the supply flow during the displacement of the wall element 26 the second distance can, as described above and shown in the embodiment according to FIG. 3, when needed be kept apart in time.

What is claimed is:

1. A method of supplying a control liquid to a rotor of a centrifugal separator by means of a supplying device (21), which has a cylinder (25), in which a displaceable wall element (26) is arranged, which axially delimits a storing chamber (29) arranged in the cylinder (25), in which storing chamber (29) a predetermined volume of control liquid is stored, and out of which at least a portion of this volume of control liquid during operation is pressed out of the storing chamber (29) into the rotor during axial displacement of the wall element (26), wherein a predetermined portion of a volume of control liquid stored in the storing chamber (29) is pressed during a first step after a supply has been initiated upon displacement of the wall element (26) a first distance at an adjustable pressure of the storing chamber (29) through a first outlet passage (33) arranged in the supplying device (21) against the influence of a first flow resistance in the first outlet passage (33) with a first flow, which is higher than a predetermined minimum flow, and wherein at least a portion of the first outlet passage (33) is closed by an opening and closing element (31) connected to the wall element (26) when this is displaced the first distance, and at least a portion of the remaining volume of control liquid in the storing chamber (29) is pressed during a second step following the first step upon continuing displacement of the wall element (26) a second distance against the influence of a second flow resistance, which is higher than the first flow resistance, out of the storing chamber (29) through a second outlet passage (36,37) arranged in the supplying device (21) with a second flow, which is substantially lower than the first flow.

2. A method according to claim 1, wherein the first and the second outlet passage (33 and 36,37 respectively) are kept closed during the displacement of the wall element (26) a third distance, which keeps the first and the second distance apart, the supply device (21) also comprising a third outlet passage (38), which connects the storing chamber (29) with the conduit (19), and through which control liquid is brought to flow at least during displacement of the wall element the third distance against a third flow resistance, which is higher than the second flow resistance, whereafter the second outlet passage (36,37) is open and kept open during displacement of the wall element the second distance.

3. A method according to claim 1, wherein control liquid is pressed out of the storing chamber (29) during the first step with a flow, which at least is double as high as the flow, at which control liquid is pressed out of the storing chamber (29) during the second step.

4. A device for supplying control liquid to a rotor of a centrifugal separator, which supplying device comprises a cylinder (25), in which a wall element (26) is arranged axially displaceable in the cylinder (25), which axially delimits a storing chamber (29) arranged in the cylinder (25) arranged to store a predetermined volume of control liquid, an inlet connected to the storing chamber (29) for the supply of control liquid to the storing chamber (29) upon displacement of the wall element (26) in a first direction, an outlet passage connected to the storing chamber (29) and arranged in the supply device (21), through which at least a portion of the volume of control liquid stored in the storing chamber (29) during supply of control liquid to the rotor is pressed out of the storing chamber (29) into the rotor via a conduit (19) connected to the outlet passage upon axial displacement of the wall element (26) in a second direction, and means to press the wall element (26) in the second direction during supply of control liquid with a predetermined force, which is higher than the resulting force from a liquid pressure prevailing in the storing chamber (29), and wherein the device further comprises a first outlet passage (33) connected to the storing chamber (29), which connects the storing chamber (29) to said conduit (19), and which is arranged to admit a first flow, which is higher than a predetermined minimum flow, through the same against the influence of a first flow resistance upon displacement of the wall element (26) in the second direction a predetermined first distance, a second outlet passage (36,37) connected to the storing chamber (29), which also connects the storing chamber (29) to said conduit (19), and which is arranged to admit a second flow through the same, which is substantially lower than the first flow, against influence of a second flow resistance, which is higher than the first flow resistance, when the wall element (26) is displaced in the second direction a second distance, and an opening and closing member (31) connected to the wall element (26), which is arranged to open and keep the first outlet passage (33) open during displacement of the wall element (26) the first distance in the second direction and at least partly close the first outlet passage (33) when the wall element (26) is displaced the first distance and to keep the first outlet passage (33) at least partly closed during continuing displacement of the wall element (26) in the second direction.

5. The device according to claim 4, which it is arranged to keep the first and the second outlet passage (33 and 36,37 respectively) closed upon the displacement of the wall element (26) a third distance, which keeps the first and the second distance apart, the device also comprising a third outlet passage (38), via which the storing chamber (29) is connected to the conduit (19), and which is arranged to admit at least upon displacement of the wall element (26) the third distance a flow through the same against a third flow resistance, which is higher than the second flow resistance.

6. Device according to claim 4, wherein said means to press the wall element (26) in the second direction is arranged to press the wall element (26) by means of pressurized air, the wall element (26) also delimiting axially a pressure chamber, which is arranged to be filled up with pressurized air at an adjustable pressure during displacement of the wall element (26) in the second direction and to be emptied by air during displacement of the wall element (26) in the first direction.

7. A centrifugal separator, which it is provided with a device according to claim 4.

* * * * *